US011725289B2

(12) United States Patent
Glass et al.

(10) Patent No.: US 11,725,289 B2
(45) Date of Patent: Aug. 15, 2023

(54) EXPANDABLE ANODE ASSEMBLY

(71) Applicant: E-CHEM TECHNOLOGIES LTD., Nottinghamshire (GB)

(72) Inventors: Gareth Glass, Lichfield (GB); Stephen Glass, Pretoria (ZA); Adrian Roberts, Nottinghamshire (GB); Nigel Davison, Swadlincote (GB)

(73) Assignee: E-CHEM TECHNOLOGIES LTD., Chilwell (GB)

( * ) Notice: Subject to any disclaimer, the term of this patent is extended or adjusted under 35 U.S.C. 154(b) by 60 days.

(21) Appl. No.: 16/615,946

(22) PCT Filed: May 22, 2018

(86) PCT No.: PCT/GB2018/051384
§ 371 (c)(1),
(2) Date: Nov. 22, 2019

(87) PCT Pub. No.: WO2018/215755
PCT Pub. Date: Nov. 29, 2018

(65) Prior Publication Data

US 2020/0095690 A1 Mar. 26, 2020

(30) Foreign Application Priority Data

May 22, 2017 (GB) ..... 1708199

(51) Int. Cl.
*C23F 13/18* (2006.01)
*C23F 13/14* (2006.01)
(Continued)

(52) U.S. Cl.
CPC ..... *C23F 13/18* (2013.01); *C23F 13/14* (2013.01); *C23F 13/20* (2013.01); *E01C 11/04* (2013.01);
(Continued)

(58) Field of Classification Search
CPC ..... C23F 13/18; C23F 13/06; C23F 13/20; C23F 2201/02; C23F 13/14; E01C 11/04;
(Continued)

(56) References Cited

U.S. PATENT DOCUMENTS 3,307,318 A * 3/1967 Bauman ..... B29C 67/20 52/742.11
4,287,696 A 9/1981 Mullen
(Continued)

FOREIGN PATENT DOCUMENTS

GB 2 389 591 A 12/2003
GB 2389591 A * 12/2003 ..... C23F 13/16

OTHER PUBLICATIONS

Higgins, Raymond A., "Some Fundamental Chemistry" in Engineering Metallurgy-Applied Physical Metallurgy (6th Edition), Elsevier, 1993 (Year: 1993).*
(Continued)

*Primary Examiner* — Alexander W Keeling
*Assistant Examiner* — Mofoluwaso S Jebutu
(74) *Attorney, Agent, or Firm* — Finch & Maloney PLLC

(57) ABSTRACT

An array of anode assemblies for insertion at a plurality of locations in a gap between a section of a reinforced concrete structure and another solid structure is provided. Each anode assembly comprises an expandable member, an anode attached to the expandable member for protecting a steel reinforcement in the reinforced concrete structure, and an anode connector for interconnecting the array of anode assemblies. During use, each anode assembly of the array of anode assemblies is inserted into the gap, between the section of the reinforced concrete structure and the solid structure, at the plurality of locations. The expandable
(Continued)

member of each anode assembly is configured to expand so as to press the anode into contact with a surface of the reinforced concrete structure.

28 Claims, 6 Drawing Sheets

(51) Int. Cl.

| | |
|---|---|
| ***C23F 13/20*** | (2006.01) |
| ***E01C 11/04*** | (2006.01) |
| ***E01D 19/06*** | (2006.01) |
| ***E02D 31/06*** | (2006.01) |

(52) U.S. Cl.
CPC ..... *E01D 19/06* (2013.01); *E02D 31/06* (2013.01); *C23F 2201/02* (2013.01)

(58) Field of Classification Search
CPC ..... E01C 11/10; E01D 19/06; E02D 31/06; E04B 1/68
See application file for complete search history.

(56) References Cited

U.S. PATENT DOCUMENTS

| | | | | |
|---|---|---|---|---|
| 5,183,694 | A * | 2/1993 | Webb | C23F 13/02 204/196.3 |
| 7,998,321 | B1 * | 8/2011 | Giorgini | C23F 13/18 204/196.34 |
| 8,541,084 | B2 * | 9/2013 | Deiss | E06B 1/62 428/40.1 |
| 2008/0156660 | A1 | 7/2008 | Tettamanti et al. | |
| 2012/0111736 | A1 * | 5/2012 | Glass | C23F 13/06 205/734 |
| 2012/0152732 | A1 * | 6/2012 | Tarrant | C23F 13/20 204/196.3 |
| 2014/0251793 | A1 | 9/2014 | Funahashi et al. | |
| 2015/0284860 | A1 * | 10/2015 | Glass | C23F 13/06 205/731 |

OTHER PUBLICATIONS

Bennett, J.E.; Bushman, James B.; Clear, Kenneth C.; Kamp, Robert N.; and Swiat, Wayne J., "Cathodic Protection of Concrete Bridges: A Manual of Practice", 1993, Strategic Highway Research Program (Year: 1993).*

Drobny, Jiri George, "Processing Methods Applicable to Thermoplastic Elastomers" in Handbook of Thermoplastic Elastomers, 2007, William Andrew Publishing/Plastics Design Library, pp. 107-160 (Year: 2007).*

Troughton, Michael J, "Heat Sealing" in Handbook of Plastics Joining (Second Edition), 2009, Wiliam Andrew Publishing, pp. 121-126 (Year: 2009).*

Pethrick, Richard A., "Composites" in Polymer Science and Technology for Scientists and Engineers, 2010, Whittles Publishing, pp. 147-186 (Year: 2010).*

David Hitzler, "Technical Data Sheet—Blu-tack", Bostik Australia, Jun. 2015 (Year: 2015).*

Biron, Michel, "Polyoxymethylene, Polyacetal, Acetal, or Polyformaldehyde (POM)" in Thermoplastics and Thermoplastic Composites (3rd Edition), Elsevier, 2018, pp. 464-481 (Year: 2018).*

"Elastomer", Encyclopedia Britannica, Inc., Aug. 7, 2019 (Year: 2019).*

"Tygon® Lab (R-3603) Tubing", Cole-Parmer, 2020 (Year: 2020).*

"Type WE10 Ag/AgCI 0.5 M KCI Embeddable Reference Electrode for Use in Concrete", Silvion Limited , 2020 (Year: 2020).*

"Heat-seal", Merriam-Webster.com, accessed 2021 (Year: 2021).*

International Search Report Corresponding to PCT/GB2018/051384 dated Jul. 19, 2018.

Written Opinion Corresponding to PCT/GB2018/051384 dated Jul. 19, 2018.

Lambert, Paul et al, "Dual function carbon fibre fabric strengthening and impressed current cathodic protection (ICCP) anode for reinforced concrete structures", Materials and Structures, Published Online: Apr. 3, 2014, pp. 2157-2167, vol. 48, No. 7, Springer, Dordercht, Netherlands, DOI: 10.1617/S11527-014-0300-0 See EP Exam Report.

European Examination Report corresponding application No. 18 727 407.1 dated Jan. 30, 2023.

British Examination Report corresponding to application No. 1918859.8 dated Mar. 8, 2023.

Wikipedia. Catholic protection—Wikipedia [retrieved from the internet Mar. 22, 2023] <URL: https://en.wikipedia.org/w/index.php?title=Cathodic_protection&oldid=772502278> Published Mar. 27, 2017 as per edit history. See AU Exam Report—stating document defining the general state of the art which is not considered to be of particular relevance.

Australian Examination Report corresponding application No. 2018274696 dated Mar. 30, 2023.

* cited by examiner

EXPANDABLE ANODE ASSEMBLY

TECHNICAL FIELD OF THE INVENTION

The present invention relates to an expandable anode assembly for protecting reinforcement in a reinforced concrete structure and in particular an array of anode assemblies suitable for insertion at a plurality of locations in a gap between a section of a reinforced concrete structure and another solid structure. The invention also relates to a method of producing an anode assembly and to a method of protecting a reinforcement in a reinforced concrete structure using said anode assembly, in particular said array of anode assemblies.

BACKGROUND TO THE INVENTION

Reinforced concrete is a composite material in which a reinforcement, typically of a metal such as steel, is used to counteract concrete's relatively low tensile strength and ductility. Steel reinforced concrete structures are known to suffer from corrosion as a result of carbonation or chloride contamination in concrete. When the steel reinforcement corrodes it produces by-products which occupy a larger volume than the steel from which they are derived. This in turn leads to cracking of the concrete and accelerates the rate of corrosion of the steel reinforcement due to it becoming increasingly exposed to water and oxygen in the atmosphere.

Corrosion in concrete is an electrochemical process and various electrochemical treatments have been adopted to address this problem. Both sustained and temporary electrochemical treatments are established treatments for inhibiting corrosion of steel reinforcements in concrete. These involve passing a current through the concrete to the steel from an installed anode system. In all cases the steel becomes the cathode of the electrochemical cell that is formed. In an impressed current electrochemical treatment, the anode of the system is connected to the positive terminal and the steel is connected to the negative terminal of a source of DC power. In a sacrificial electrochemical treatment, the protection current is provided by corroding sacrificial anodes that are directly connected to the steel.

Bridges and tunnels are examples of reinforced concrete structures where multiple sections of reinforced concrete are joined together using expansion joints. The expansion joints are designed to span the gap between adjacent reinforced concrete elements and provide space for movement of at least one of the elements which may expand and contract in response to changes in temperature for example. An example of a reinforced concrete element is the deck of a bridge which will expand and contract with changes in temperature. The expansion joint at the end of the deck is often felt as unevenness in a road surface. The gaps at these joints extend for the full height and width of the concrete element.

These concrete elements also tend to be heavily reinforced. Steel reinforcements present at the ends of adjacent concrete sections are particularly susceptible to corrosion since de-icing and marine salts are known to accumulate in the gaps formed between adjacent reinforced concrete sections. One anode installation method involves inserting an anode into a drilled hole or slot formed in the body of the concrete structure. However this is inhibited by the heavy steel reinforcement which must not be damaged by the formation of the hole. Another anode installation method involves attaching an anode to an exposed concrete surface.

However, since the gaps are relatively narrow, e.g. 15 to 200 mm, and are prone to movement, difficulties arise when trying to install sacrificial or impressed current anode systems on the concrete surface exposed in the gap.

Anode assemblies have since been developed which are adapted to be inserted into gaps defined by opposing sections of reinforced concrete. Such assemblies are known from GB2389591. In particular, GB2389591 discloses an inflatable anode assembly which is used to maintain contact between the anode and the concrete when in its inflated configuration. According to GB2389591 the inflatable anode assembly is inflated by admitting a non-compressible fluid to a cavity formed in a deformable material such as a rubber tube. A disadvantage of the inflatable assembly of GB2389591 is that contact between the anode and the concrete could be lost if the deformable material is damaged or corroded to an extent that the non-compressible fluid is caused to leak from the cavity. In this case, the deformable material would deflate and return to its original volume thereby bringing the anode out of contact with the concrete surface. Other anode assemblies are disclosed in GB2389591 but these have to be forcibly inserted into the gap defined by opposing reinforced concrete sections and therefore there is an increased risk of these anode assemblies becoming damaged during the installation procedure. A further disadvantage of the anode assemblies disclosed in GB2389591 is that the deformable materials are susceptible to attack by contaminants such as engine oil and some tar products present on the roads.

This will limit the working lifetime of the anode assemblies and their ability to protect the steel reinforcements over extended periods of time. Another disadvantage of the anode assemblies disclosed in GB2389591 is that gaps vary in size and the anode assemblies have to be made to fit a specific gap.

In light of the above, it is a primary object of embodiments of the present invention to provide an anode assembly which is easy to install. It is also an object of certain embodiments of the present invention to provide an anode assembly having improved durability and resistance to contaminants. It is another object of embodiments of the present invention to provide an anode assembly that ensures that the anode will be kept in contact with a concrete surface of a reinforced concrete structure for an extended period of time.

SUMMARY OF THE INVENTION

According to a first aspect of the invention there is provided an array of anode assemblies for insertion at a plurality of locations in a gap between a section of a reinforced concrete structure and another solid structure, wherein each anode assembly comprises an expandable member, an anode attached to the expandable member for protecting a steel reinforcement in the reinforced concrete structure, and an anode connector for interconnecting the array of anode assemblies, whereby in use, each anode assembly of the array of anode assemblies is inserted into the gap between the section of the reinforced concrete structure and the solid structure at the plurality of locations, wherein the expandable member of each anode assembly is configured to expand so as to press the anode into contact with a surface of the reinforced concrete structure.

An array of anode assemblies, each being configured for insertion into a gap and subsequent expansion to bring respective anodes into contact with the same concrete surface provide a system by which gaps of any size can be easily accommodated. For example, longer gaps may easily be accommodated by increasing the number of anode assemblies included in the array, while the width of the gap is tailored for by the degree of expansion undergone by the expandable member. Meanwhile, installation is facilitated since a complete anode assembly can simply be inserted in the gap prior to expansion of the expandable member. Each anode assembly does not have to be forcibly inserted into the gap between opposing concrete elements since the thickness of the assembly when in its un-expanded configuration will be less than the thickness of the gap. The above advantages are important since the installer of an array of anode assemblies does not typically have much time to access and evaluate an installation site before arrival. The present anode assembly array allows an installer to arrive at an installation site with multiple anode assemblies of a single type and quickly configure the installation based on the state of the installation site. Furthermore, the reduced volume of the anode assembly also means that the anode assemblies are easier to store and transport thereby reducing storage and transportation costs. Further, this design of the anode assembly array also means that the anodes can be used as discrete anodes that are spaced from one another, which has the benefit that the whole of the gap does not need to be cleared out if, for example, stone or other material has become trapped in the gap.

Expandable members may include, for example, inflatable members. However, preferably the expandable member of each anode assembly comprises a compressed compressible material, wherein the compressible material of each anode assembly is configured to expand so as to press the anode into contact with a surface of the reinforced concrete structure. A compressed compressible material is particularly advantageous as expansion is provided by removing whatever is inhibiting the expansion of the compressed compressible member and nothing further needs to be added to the anode assembly.

A particularly preferable arrangement is one in which each anode assembly comprises a flexible enclosure, wherein the compressible material is sealed within the flexible enclosure under air-evacuated conditions, and wherein the anode is attached to an exterior of the flexible enclosure, whereby in use, the compressible material expands to press the anode into contact with a surface of the reinforced concrete structure when air is caused to re-enter the flexible enclosure. While this type of anode assembly is ideally used in an array, a second aspect of this invention would be a single anode assembly for insertion in a gap between a section of a reinforced concrete structure and another solid structure, wherein the anode assembly comprises a flexible enclosure; a compressible material sealed within the flexible enclosure under air-evacuated conditions, and an anode attached to an exterior surface of the flexible enclosure for protecting a steel reinforcement in the reinforced concrete structure, whereby in use, the compressible material expands to press the anode into contact with a surface of the reinforced concrete structure when air is caused to re-enter the flexible enclosure. It will be appreciated that the below features discussed in relation to the first aspect will apply equally to the single anode assembly of the second aspect.

The array of anode assemblies (or single anode assembly) according to the above preferred example has the advantage that the flexible enclosure is able to protect the compressible material from contaminants such as engine oil and tar present on the road, thereby extending the working lifetime of the anode assembly. In addition, because the expansion of the compressible material is effected by allowing air to re-enter the flexible material, e.g. by intentionally puncturing the flexible enclosure, contact between the anode of the anode assembly and the reinforced concrete surface will be maintained even if the flexible enclosure is damaged. As will be described in more detail below, additional air evacuated flexible enclosures may be added to an assembly to accommodate wider gaps. Assemblies can be linked together in any arrangement to accommodate variations in the area of concrete surface exposed in the gap.

While a compressible material in a flexible enclosure under air-evacuated conditions represents a preferred implementation of a compressed compressible material, other embodiments are foreseen. For example, a compressible material may be compressed and bound by one or more retaining straps that inhibit the expansion of the compressible material. In this case, installation may be completed by inserting the anode assembly in the gap and cutting the retaining strap(s).

Returning to the preferred embodiment comprising a compressible material in a flexible enclosure under air-evacuated conditions, the flexible enclosure may be made from plastics. In particular the flexible enclosure may be made from a thermoplastic material. The flexible enclosure may comprise an inner layer and an outer layer. The inner layer may be formed from a heat sealable material such as polyethylene while the outer layer may be formed from an air-impregnatable material such as polyamide.

The flexible enclosure may comprise a heat seal for sealing the compressible material inside the flexible enclosure.

In some embodiments an inner surface of the flexible enclosure is dimpled. The dimpled surface helps to keep the compressible material in place as air is evacuated and assists in the evacuation of air from the flexible enclosure.

Where the expandable member comprises a compressed compressible material, the compressible material may be a compressible resilient material. For instance, the compressible material may be a foamed polymeric material. In particular, the compressible material may be an open cell foamed material. Closed cell foams are less preferred because they are either not compressible or only exhibit limited compressibility relative to open cell foams. Alternatively, the compressible material may be a semi-open foamed material.

The foamed material may have a density greater than 30 $kg/m^3$. If the foam density is below 30 $kg/m^3$ then the foam may be too soft and may not be able to exert sufficient force as it expands to press and hold the anode against the surface of the reinforced concrete structure. In particular, the density of the foamed material may be between 30 and 100 $kg/m^3$. In some embodiments the density may be about 50 $kg/m^3$.

The foamed material may comprise polyurethanes.

Each anode may be a discrete anode, typically a compact discrete anode and the anode connector of each anode assembly may be interconnected via an interconnecting conductor. Discrete is a term in the art that is used to describe a class of anodes that may be either embedded within concrete or applied to concrete surfaces. Discrete anodes are supplied as a number of distinct units for installation on the same element of the concrete structure (typically more than one discrete anode is applied to each square meter of concrete surface). In the context of this application a discrete anode may be considered a surface applied anode where the anode is sized such that at least two anodes would be applied to each square metre of concrete surface. Further, each anode has its own connector and the connectors are suited to being interconnected together with another connector. An interconnecting connector is supplied as an item that is separate from the anodes that may be used to interconnect the anodes either before or after they are inserted into the gap. The anodes may be interconnected via a junction box when the system is to be monitored. The anode connectors and interconnector may comprise titanium for example.

The, or each, anode can be an inert anode for use in an impressed current cathodic protection treatment or it can be a sacrificial anode. If sacrificial protection current is to be delivered the anodes will be sacrificial anodes and will be connected directly to the steel. The sacrificial anode may comprise zinc, zinc alloy, aluminium or an aluminium alloy. On the other hand, if impressed current is to be delivered, the anode may be an anode such as activated titanium and the anode will be connected to a positive terminal of a DC power supply, with the steel being connected to the negative terminal of that power supply.

At least one anode assembly of the array of anode assemblies may comprise a second anode attached to the expandable member (for example, provided on an exterior surface of the flexible enclosure) opposite the attached anode (here referred to as the first anode). Here, opposite the attached anode means on a side of the assembly opposite the first anode such that it is suitable for contacting a concrete surface facing the surface protected by the first anode. That is, the other solid structure referred to above may be another reinforced concrete surface and the second anode is arranged to be brought into contact with this surface when the anode assembly expands. By providing an anode on each face of the flexible enclosure rather than on a single face, it is possible to deliver current to two opposing faces of concrete. In some cases, the second anode is provided on an exterior surface of the flexible enclosure, mentioned above, opposite the attached anode, although it is not essential that it be provided on the same flexible enclosure. An anode assembly may comprise a plurality of flexible enclosures. An alternative way of protecting opposing surfaces of a gap would be to provide an array of anode assemblies in which a first plurality of anode assemblies are reversed with respect to a second plurality of anode assemblies such that the first plurality of anode assemblies expand and press their respective anode in contact with a first concrete surface and the second plurality of anode assemblies expand and press their respective anode in contact with a second concrete surface facing the first concrete surface. This arrangement may be preferred for very thin gaps that cannot accommodate additional anodes or flexible enclosures on each anode assembly.

The anode may be attached to the expandable member, or flexible enclosure, using an elastomeric adhesive. The elastomeric adhesive may be a silicone based adhesive. The use of an elastomeric adhesive enables a robust but flexible bond to be formed between the anode and the expandable member, or flexible enclosure, so that the anode is retained on the expandable member as it expands. The elastomeric adhesive also enables the bonded anode to tolerate movements of the reinforced concrete sections when pressed against the concrete surface in use.

The ratio of unexpanded to expanded assembly thickness may be at least from about 1:2, preferably at least 1:3, more preferably at least 1:4. In particular, the ratio may be from about 1:2 to about 1:10. In some embodiments the ratio is about 1:7 while in other embodiments the ratio can be about 1:3, about 1:4, about 1:5 or about 1:6. For instance, the thickness of the anode assembly may be reduced from about 50 mm to about 10 mm which makes the anode assembly of the present invention suitable for insertion into 15-40 mm gaps. Additional expandable members may be added for wider gaps. In this way, all expandable members can be manufactured the same, which increases manufacturing efficiency, and each assembly composed by joining together the appropriate number of expandable members. For example, where a flexible enclosure containing a compressible material is used, multiple enclosures can be arranged back-to-back to accommodate a wider gap.

As mentioned above, the assemblies are typically manufactured of a fixed, relatively small size, and an array interconnected with total number depending on the length of the gap. Preferably, each anode measures at most 400 mm by 400 mm, preferably at most 300 mm by 400 mm, more preferably at most 300 mm by 300 mm, most preferably at most 200 mm by 300 mm. These smaller anodes are well suited to accommodating any shape and size of gap.

Preferably, each anode assembly has a maximum thickness in an unexpanded state of at most 15 mm, preferably at most 10 mm, more preferably 8 mm or less. Such anode assemblies are conveniently installed into gaps prior to expansion. In particular, the air-evacuated anode assembly described above is particularly suitable for allowing assemblies to achieve these small thicknesses.

The anode and the anode connector will typically be formed of different materials. In order to join these materials together, preferably each anode comprises a first and a second layer of anode material, the anode connector extending between the first and second layers of anode material, thereby forming a connection with the anode. Preferably the first and second layers of anode material comprise zinc and, as mentioned, preferably the conductor comprises titanium. Preferably, the first and second layers of anode material are welded together, thereby securing the anode connector therebetween, although other joining means are foreseen. In particular, spot welding may be used to connect the anode layers and optionally to connect at least one of the anode layers directly to the anode connector for a more secure connection.

As has been mentioned, each anode assembly can be made to accommodate wider gaps by providing additional expandable members. In one example of this, at least one anode assembly comprises a first flexible enclosure and a second flexible enclosure arranged next to the first flexible enclosure, and a compressible material sealed within each flexible enclosure, preferably under air-evacuated conditions in each flexible enclosure, whereby in use, the at least one anode assembly is inserted into the gap between the section of the reinforced concrete structure and the solid structure with the compressible material in the first and/or second flexible enclosure in a compressed state, the compressible material in the first and/or second flexible enclosure being configured to expand so as to press the anode into contact with a surface of the reinforced concrete structure when air is caused to re-enter the first and/or second flexible enclosure. Preferably, the first flexible enclosure is attached to the second flexible enclosure, preferably by an adhesive although other joining means are foreseen. In this configuration, a first and second anode may be provided wherein the first and second anodes are attached on corresponding exterior surfaces of the first and second flexible enclosures, facing away from one another. This may, again, allow both faces of the gap to be protected by each anode assembly. It will be appreciated that further flexible enclosures may be included between the first and second flexible enclosures to accommodate even larger gaps and to allow both faces of said gap to be protected.

Typically, the anode assembly comprises at least three anode assemblies, preferably at least four anode assemblies, more preferably at least five anode assemblies and most preferably at least ten anode assemblies. Of course, the precise number of anode assemblies will, in each case, be dependent on the shape and size of the structure being protected.

Preferably, at least one of the anode assemblies comprises a reference electrode mounted to, preferably embedded in, and electrically isolated from the anode, and a reference electrode conductor for connecting the reference electrode to measuring apparatus, the reference electrode conductor being electrically isolated from the anode. It will typically be desirable to take measurements at this anode in isolation and so if and when the array of anode assemblies are interconnected, they will typically not be interconnected with the reference electrode containing anode. For example, we may have two or more interconnected anodes and an additional anode comprising a reference electrode connected separately to measuring equipment. This embodiment is particularly preferable as in the past it has been necessary to install reference electrodes separately from anode assemblies, which increases time and cost to install a system for protecting the reinforced concrete. By including a reference electrode on at least one anode assembly, measurements can be made directly at the anode and installation of the reference electrode is completed simultaneously with anode assembly installation.

So that an adequate treatment is delivered, preferably the anode assembly array is configured such that the anode assemblies are arranged at a density of at least two assemblies per square meter of reinforced concrete surface, preferably at least four assemblies per square meter of reinforced concrete surface.

According to a third aspect of the invention, a structure is provided comprising a gap between a section of a reinforced concrete structure and another solid structure (preferably a second reinforced concrete structure), the structure containing in the gap an array of anode assemblies as described above. It will be appreciated that the installed assembly array may have any of the above described preferable features. The structure may have anode assemblies arranged at a density of at least two assemblies per square meter of reinforced concrete surface, preferably at least four assemblies per square meter of reinforced concrete surface According to a fourth aspect of the invention there is provided a method of producing an anode assembly for insertion into a gap between a section of a reinforced concrete structure and another solid structure, the method comprising the steps of: providing an expandable member in an unexpanded state; and attaching an anode to the expandable member; wherein the unexpanded expandable member is suitable for expanding (i.e. once the assembly is inserted into a gap) so as to press the anode into contact with a surface of the reinforced concrete structure.

A preferred method of producing an anode assembly for insertion into a gap between a section of a reinforced concrete structure and another solid structure, comprises the steps of: providing a compressible material; compressing the compressible material; fixing the compressible material in a compressed state.

A further preferred method comprises providing a compressible material in a flexible enclosure; evacuating air from within the flexible enclosure to compress the compressible material; sealing the compressible material in the flexible enclosure, and attaching an anode to an exterior surface of the flexible enclosure. It will be appreciated that this corresponds to a method of producing an anode assembly of the second aspect of the invention.

The method according to the fourth aspect of the invention can be used to produce the anode assembly/assemblies of the first and second aspects of the invention and therefore the method according to the fourth aspect of the invention may, as appropriate, contain any or all features described in relation to the first and second aspect of the invention.

The compressible material may be heat sealed within the flexible enclosure.

This may be achieved by passing the compressible material through an opening in the flexible enclosure, closing the opening and subjecting the closure to a heat treatment to form the heat seal. This process may for instance be carried out by a vacuum packing machine, in which case, before the flexible enclosure opening is heat sealed, air is removed from the flexible enclosure to compress the compressible material.

Alternatively, the compressible material could be sealed within the flexible enclosure and then air could be removed after the sealing step. This may be possible if the flexible enclosure comprises a valve. The valve also provides a quick an easy way of allowing air to re-enter the flexible enclosure to effect expansion of the compressible material. Because it is not necessary to break the seal, e.g. by puncturing the flexible enclosure, this means that the compressible material is better protected from contaminants such as engine oil and tar present on the road which could corrode the compressible material.

A weight may be provided on the flexible enclosure in a region defined by the compressible material before evacuating air from within the flexible enclosure, preferably such that the compressible material compresses substantially only in one dimension when air is evacuated from within the flexible enclosure. This helps to ensure that the flexible enclosure is kept substantially flat during the air evacuation step. This makes it easy to insert into a gap and helps to ensure that a robust bond is formed between the anode and the flexible enclosure.

In an embodiment of the invention a second anode may be attached to an exterior surface of the expandable member, for example the flexible enclosure, opposite the attached anode. The second anode may be the same or different to the attached anode. The anodes may be attached to the expandable member using an elastomeric adhesive. By attaching an anode to each face of the expandable member, current can be delivered to two opposing concrete faces rather than a single concrete face.

According to a fifth aspect of the invention there is provided a method of installing an anode assembly array in a gap between a section of reinforced concrete and another structure, the method comprising the steps of: inserting each anode of the array of anode assemblies according to the first aspect or each anode of an array of anode assemblies produced according to the fourth aspect into the gap at a respective location, interconnecting the array of anode assemblies by the anode conductors (typically using an interconnecting connector), and allowing the expandable member of each anode assembly to expand after insertion of the respective anode assembly, whereby expansion of the expandable member presses the respective anode attached to the expandable member into contact with a surface of the reinforced concrete structure. It should be noted here that the step of interconnecting the anodes may be performed before or after insertion into the gap and before or after expansion of the expandable members.

Preferably, each anode assembly comprises a flexible enclosure and a compressible material sealed within the flexible enclosure under air-evacuated conditions, and the compressible material is caused to expand by allowing air to re-enter the flexible enclosure to cause expansion of the compressible material, wherein preferably air is allowed to re-enter by puncturing the flexible enclosure or breaking the seal. If the flexible enclosure comprises a valve then expansion of the compressible material can be achieved simply by opening the valve.

The method according to the fifth aspect of the invention makes use of the anode assembly array according to the first aspect of the invention or an array of assemblies according to the second aspect of the invention, or the anode assembly array produced using the method according to the fourth aspect of the invention. Accordingly, the method according to the fifth aspect of the invention may include, as appropriate, any or all features described in relation to the first, second and fourth aspects of the invention.

A layer of a bedding material may be provided on the anode. In particular, the bedding material may be provided on an outer surface of the anode. The bedding material improves the electrolytic contact between the anode of the assembly and the concrete surface. The bedding material may for example comprise lime putty. Alternatively, a layer of adhesive may be provided on the outer anode surface to bond the anode to the concrete. The adhesive may comprise an electrolyte which allows current to run through it. The adhesive may be a latent adhesive.

Multiple anode assemblies are inserted at predetermined locations along the gap. The anodes of each assembly are connected together using an interconnecting conductor. Each unit may have its own connector and another interconnecting conductor may be provided to connect the anode connectors together at anode connections. The anode assemblies may be arranged in the gap so that the connectors are exposed at the edge of the gap. This enables the discrete anodes to be connected quickly and efficiently. The use of discrete anodes also offers a more versatile way to protecting steel in reinforced concrete because of its ability to accommodate variations in the size of the gap.

DETAILED DESCRIPTION OF THE INVENTION

In order that the invention may be more clearly understood an embodiment thereof will now be described, by way of example only, with reference to the accompanying drawings, of which:

EXAMPLE 1

Figure 1:
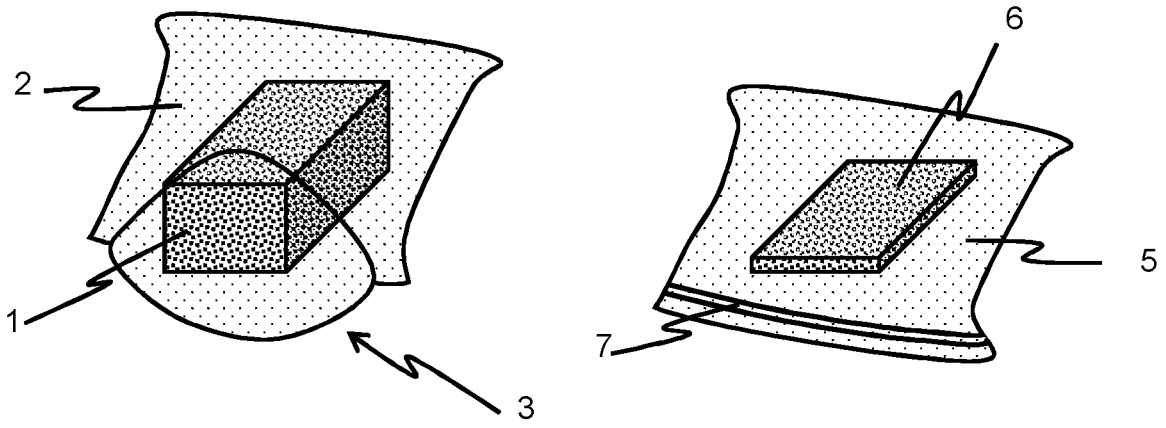
FIG. 1 shows a perspective view of an expanding component of a single anode assembly.

The expanding component of the anode assembly was constructed using blocks of foam 1, a vacuum packing machine (not shown) and vacuum pouches 2. The foam block 1 was polyurethane upholstery foam with a density of about 50 kg/m$^3$. The foam 1 was resilient as opposed to a memory foam and measured about 185×105×47 mm.

The pouch 2 measured 300×200 mm when stored flat and was made of a clear (see through) plastic. In particular, the pouch 2 is made from a polyamide air impenetrable exterior and a polyethylene interior. The vacuum pouches 2 and vacuum packing machine were obtained from "lava vacuum packing", and were manufactured in Germany by Manfred Landig. The vacuum packing machine used was the LAVA V.100 Classic vacuum Sealer.

Each foam block 1 was placed inside the vacuum pouch 2 which in turn was placed on a flat surface next to the vacuum packing machine. An A4 sized book weighing about 1 kg was placed on top of the pouch 2 and foam 1 to keep the pouch 2 flat as air was evacuated.

The opening 3 to the pouch was inserted into the vacuum packing machine. Air was evacuated until a vacuum of about −0.8 bar was generated in the pouch 2 to form an evacuated pouch 5. This places the foam block under a pressure of about 11.6 lb/in$^2$ (about 8150 kg/m$^2$).

The pouch opening 3 was then sealed securely to prevent air from getting back in by making a heat seal 7. A heated surface in the machine presses the pouch closed and slightly melts the plastic of the pouch to make the heat seal 7. The sealed pouch contained a compressed foam block 6, with a thickness that reduced from 47 mm to about 6 mm in a substantially flat 300×200 mm pouch 5.

The position of the compressed foam 6 in the evacuated pouch 5 was visible because the evacuated pouch 5 was clear. The compressed foam 6 substantially retained the other dimensions of the foam block 1 measuring 185×105 mm. The compressed foam 6 was left compressed in the evacuated pouch 5 for a period of time before letting air back into the pouch, e.g. by deliberately puncturing the evacuated pouch 5. The recovery of the foam 1 was then observed to assess whether it had suffered any plastic deformation while compressed. The results are shown in Table 1 as a percentage recovery of the foam thickness. The data shows that a compressed anode assembly 22 may be stored without any substantial loss of resilience. Moreover, elapsed time while compressed appears to have no noticeable impact up to 6 days. All expanded samples are about the same thickness but there was a non-significant amount of plastic deformation in the foam.

TABLE 1

| Elapsed Time | % Recovery |
|---|---|
| 10 minutes | 100% |
| 6 hours | 90% |
| 2 days | 90% |
| 6 days | 90% |

EXAMPLE 2

Figure 2:
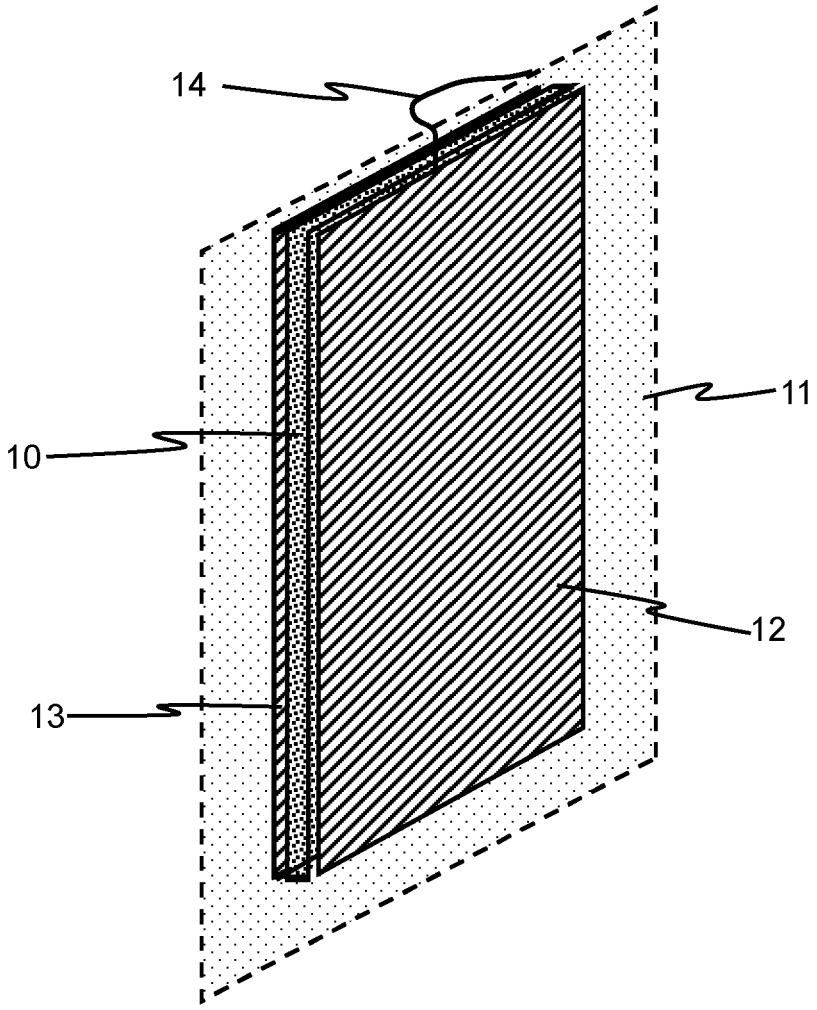
FIG. 2 shows a perspective view of the expandable anode assembly.

A single anode assembly 22 according to the present invention is best shown in FIG. 2. The assembly comprises a compressed foam 10, an evacuated vacuum pouch 11, a sheet of zinc 12 attached to an outer surface of the evacuated vacuum pouch 11, an adhesive (not shown), optionally a second sheet of zinc 13 and an electrical connector 14.

The compressed foam block 10 inside the sealed evacuated vacuum pouch 11 was prepared as described in Example 1. The foam block measured 185×105×47 mm before compression. The zinc plate 12, 13 was obtained from a zinc sheet supplier and was cut to a size of 105×185 mm. It was about 0.5 mm thick and weighed 130 grams.

The zinc plate, 12, 13 was prepared for use as an anode by soldering a copper core electric cable to the back of the plate 12, 13 and connecting it to a plastic coated titanium wire. The connection 14 was insulated with the exception of a short length of titanium that protruded just beyond the anode surface. This formed the point to connect the zinc plate 12, 13 anode to the rest of the system. Other exposed portions of conductor were covered with a Dow Corning high movement silicone.

The Dow Corning high movement silicone was used as an adhesive to attach the zinc plate 12, 13 to the pouch 11. Spots of silicone where applied to the surface of the zinc plate 12, 13 that included the connection 14. It was then positioned to contact the pouch 11 such that it covered the compressed foam block 10 in the pouch 11. The adhesive was then left to set. The overall thickness of the assembly 22 before it set was just 10 mm.

EXAMPLE 3

Figure 3:
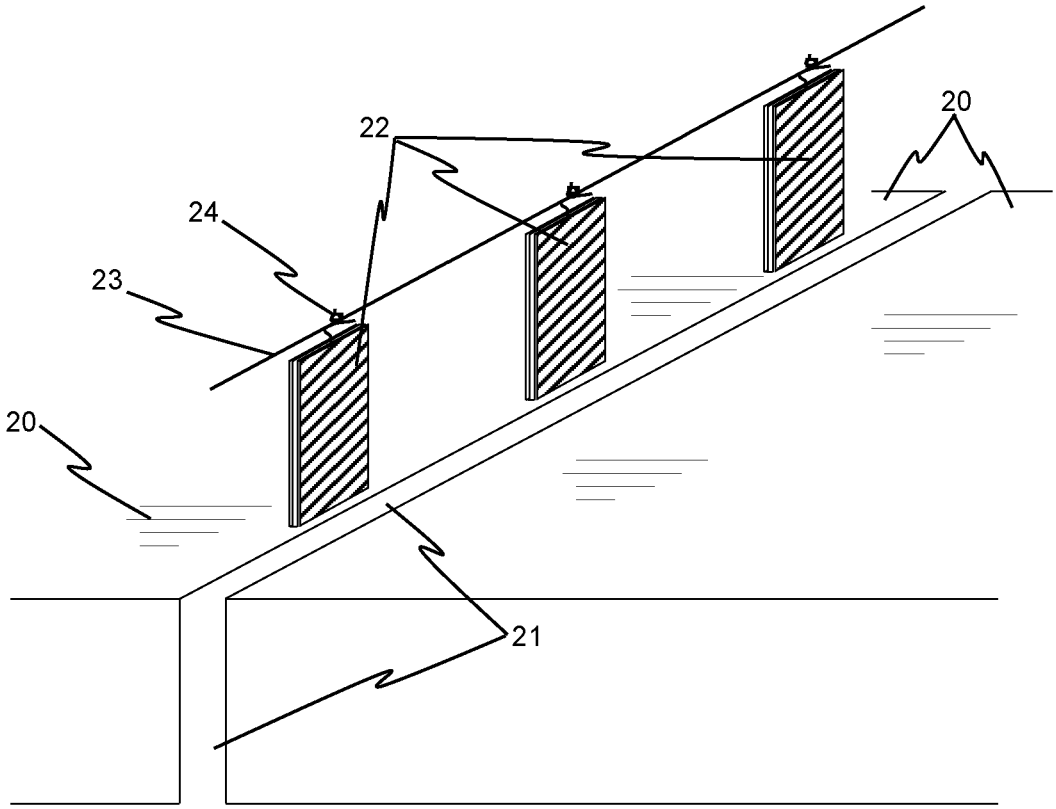
FIG. 3 shows a perspective view of an array of expandable anode assemblies installed in a gap between two concrete elements.

FIG. 3 shows an array of anode assemblies 22 installed in a gap 21 between reinforced concrete elements 20. To install the anode assemblies 22, the gap 21 at the joint between the concrete elements is cleared of debris to prepare it to receive the anode assemblies 22. The assemblies 22 are then prepared for insertion into the gap 21. This may include removing any external packaging and/or applying a thin layer of bedding material over the surface of the anode 12, 13 of the assembly 22 to facilitate electrolytic contact with the surface of the reinforced concrete elements 20. In this embodiment the bedding material was lime putty.

The anode assemblies 22 are then inserted into the gap 21 and arranged so that the assembly connectors 24 are exposed at the edge of the gap 21. The evacuated pouches 11 of the anode assembly 22 are then punctured (the seal is broken) to allow the assembly to expand and press the anode(s) 12, 13 of the assembly 22 against the surface(s) of the reinforced concrete elements 20 in the gap 21 and effectively hold the anode 12, 13 in place. An interconnecting conductor 23 is then used to connect the anode connectors 14 together at anode connections 24.

To complete the circuit a connection will also be made to the steel reinforcement. If sacrificial protection current is to be delivered the anodes will be sacrificial anodes (e.g. zinc) and will be connected directly to the steel. If impressed current is to be delivered the anodes may be inert anodes (e.g. activated titanium) and the anodes will be connected to the positive terminal of a DC power supply, while the steel will be connected to the negative terminal of that power supply.

EXAMPLE 4

Figure 4:
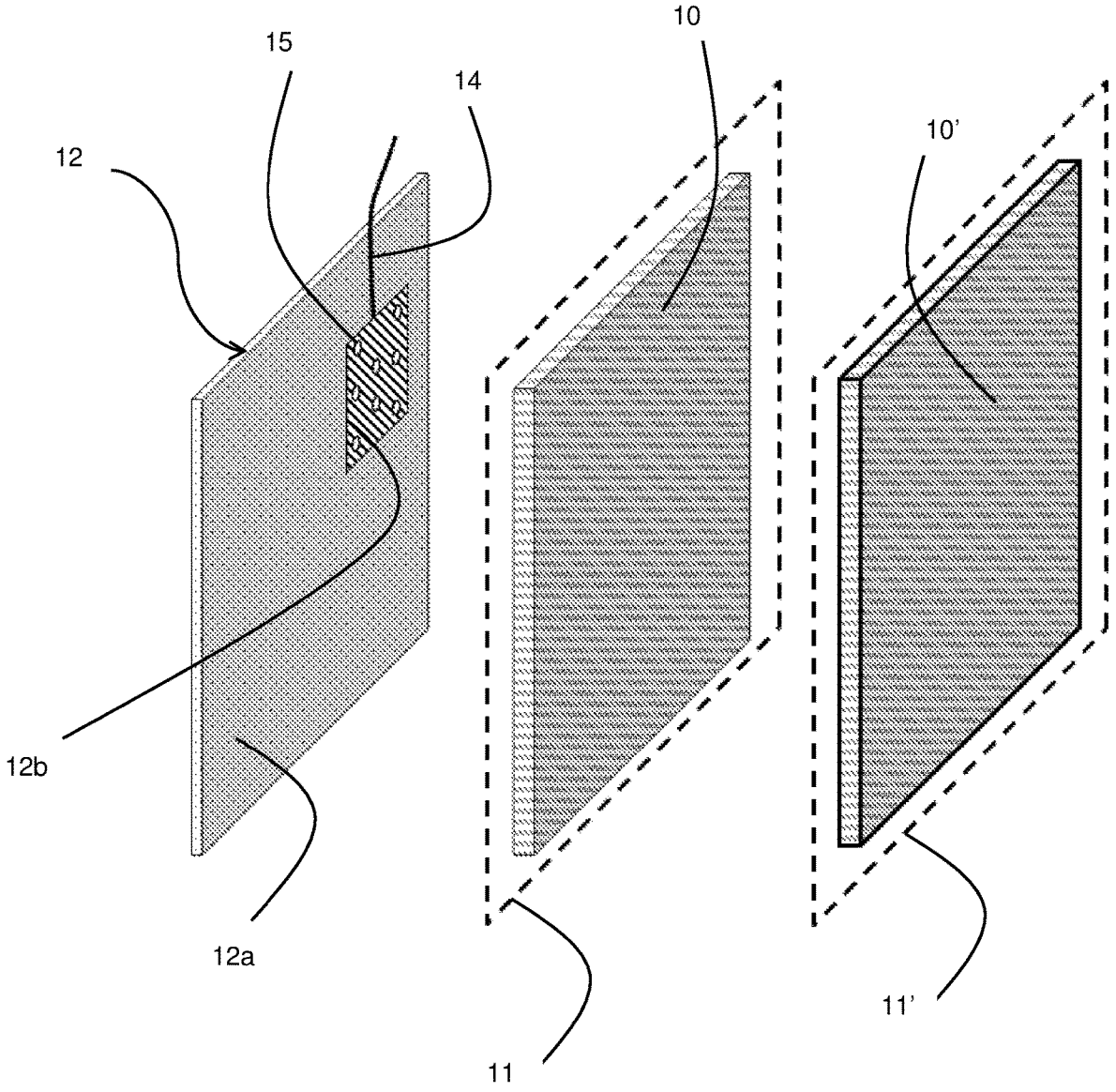
FIG. 4 shows an exploded view of a single anode assembly according to a second embodiment.

FIG. 4 shows an exploded view of another embodiment of an anode assembly for installation as part of an anode assembly array.

The anode assembly comprises a first zinc plate 12. As shown, the zinc plate comprises a first layer of zinc 12*a* and a second layer of zinc 12*b*. The second layer of zinc 12*b* is significantly smaller than the first layer of zinc 12*a* and defines an attachment region of the anode, in which the connector 14 is connected to the anode. Specifically, the connector 14, which is a titanium connector in this embodiment, extends between the first layer of zinc 12*a* and the second layer of zinc 12*b* in the attachment region. The second layer of zinc 12*b* is spot welded to the first layer of zinc at eight different locations 15 across the attachment region, although the number of spot weld points 15 can be varied as needed. This arrangement sandwiches the connector between the layers of zinc in the attachment region, firmly securing the connector to the anode and providing an electrical connection therewith.

This embodiment also contains first and second evacuated vacuum pouches 11, 11', each comprising a respective compressed foam 10, 10' as described above. The first zinc plate 12, which acts as the anode, is attached to the first evacuated vacuum pouch in the manner described above on a first surface of the first pouch 11. The second pouch 11' is arranged on a second surface of the first pouch 11, opposite the first surface. The second pouch 11' is joined to the first pouch 11 by an adhesive (not shown).

When the anode assembly is installed in a gap, typically as part of an array, both the first and second pouches 11, 11' are punctured, for example, such that the first and second pouches expand together and press the anode against a concrete surface to be protected. The use of at least two pouches 11, 11' in this manner allows for larger gaps to be accommodated by the anode assembly.

EXAMPLE 5

Figure 5:
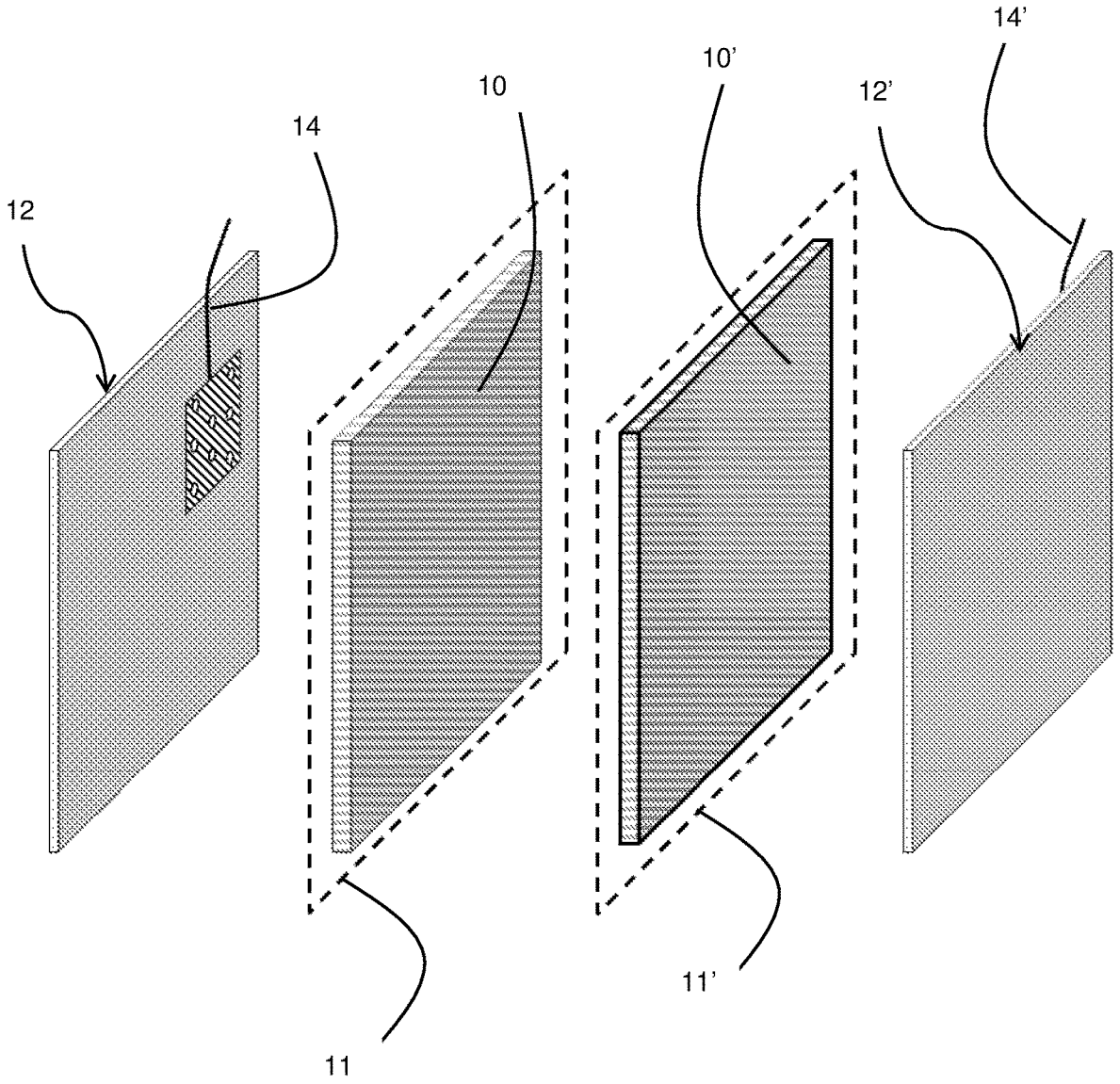
FIG. 5 shows an exploded view of a single anode assembly according to a third embodiment.

FIG. 5 shows an exploded view of another embodiment of an anode assembly for installation as part of an anode assembly array.

This embodiment is identical to the previous embodiment, but further comprises a second anode zinc plate 12' with a corresponding second connector 14'. Specifically, the second zinc plate 12' is arranged on the outer facing surface of the second pouch 11'. The second zinc plate is attached to the second pouch in the manner described above, i.e. using Dow Corning high movement silicone as an adhesive. In this embodiment, as the first and second pouches expand together and press the first anode against a first concrete surface to be protected, they simultaneously press the second anode 12' against a second concrete surface to be protected, i.e. a concrete surface facing the first concrete surface.

In practice, this embodiment may be formed on site by adhering together two identical anode assemblies such as described above with reference to FIG. 2. This allows one design of anode assembly to be adaptable to an increased range of on-site requirements.

EXAMPLE 6

Figure 6:
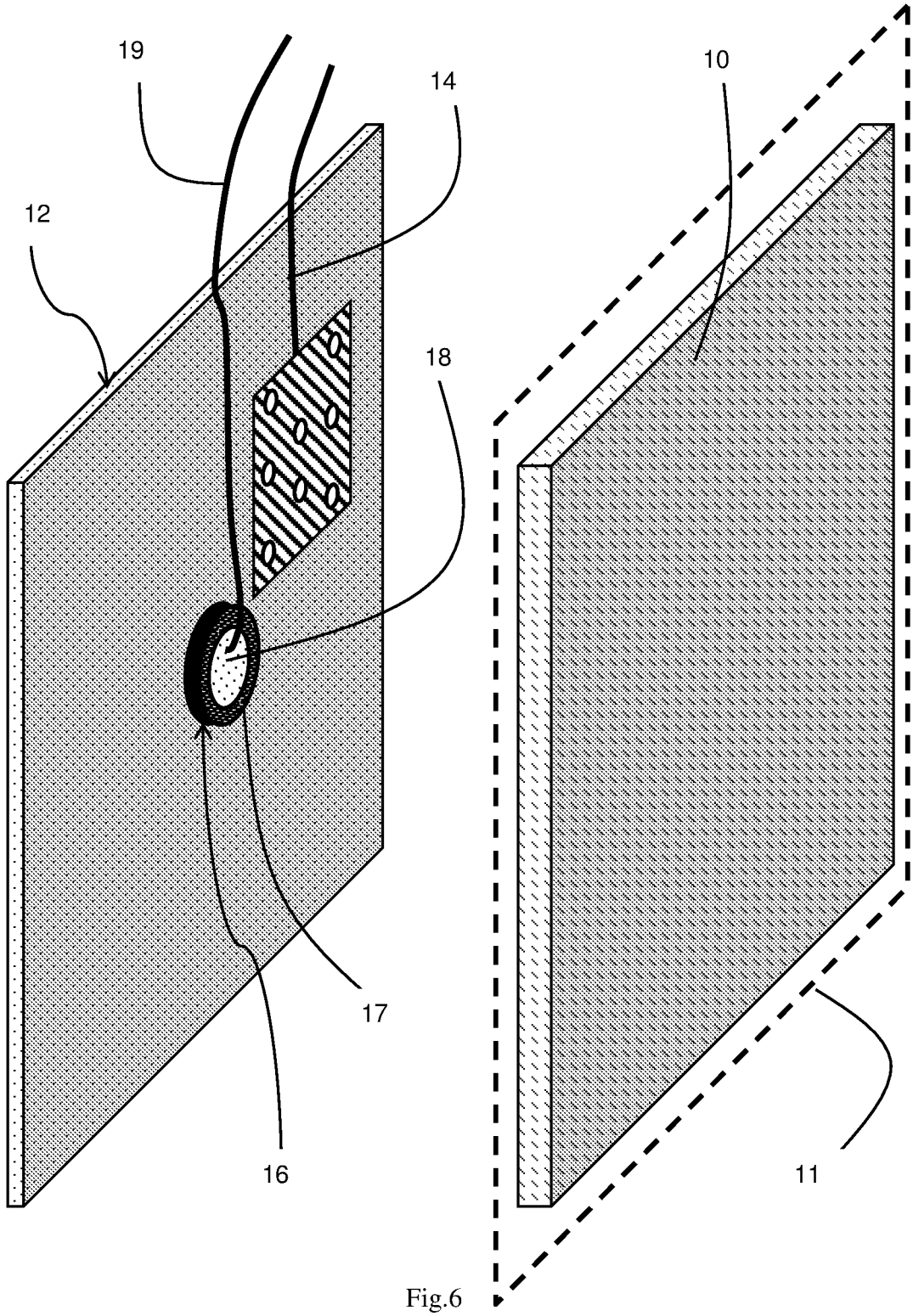
FIG. 6 shows an exploded view of a single anode assembly according to a fourth embodiment.

FIG. 6 shows an exploded view of another embodiment of an anode assembly for installation as part of an anode assembly array.

This embodiment again comprises a single evacuated pouch 11 comprising a compressed foam 10, as described above with reference to FIG. 2. The assembly also comprises a zinc plate made up of a first layer of zinc 2*a* and a second layer of zinc 12*b*, as described above with respect to FIG. 4.

In addition, the anode assembly of this embodiment comprises a reference electrode 16. The reference electrode is mounted on a surface of the first layer of zinc 12*a* of the zinc plate facing the evacuated pouch 11, outside of the attachment region defined by the second layer of zinc 12*b*. The reference electrode comprises an insulating ring 17 that isolates a reference electrode core 18, located within the insulating ring, from the first layer of zinc 12*a* of the zinc plate 12. The insulating ring 17 may be made from any insulating material, for example rubber. The electrode core 18, in this embodiment, comprises an activated titanium mesh embedded in a lime cement. An insulated connecting wire 19 extends from the electrode core 18 between the first layer of zinc 12*a* of the zinc plate and the pouch 11 out and away from the assembly for connecting the reference electrode to measuring equipment (not shown).

The above embodiments are described by way of example only. Many variations are possible without departing from the scope of the invention as defined in the appended claims.

The invention claimed is:

1. An array of anode assemblies for insertion at a plurality of locations in a gap between a section of a reinforced concrete structure and another solid structure, at least one of the anode assemblies comprising:

an expandable member;

an anode attached to the expandable member for protecting a steel reinforcement in the reinforced concrete structure;

an anode connector for interconnecting the array of anode assemblies, whereby in use, each anode assembly of the array of anode assemblies is inserted into the gap, between the section of the reinforced concrete structure and the solid structure, at the plurality of locations;

the expandable member of each anode assembly comprises a compressed compressible material, and the compressible material of each anode assembly is configured to expand so as to press the anode into contact with a surface of the reinforced concrete structure;

wherein each anode assembly comprises a flexible enclosure, and the compressible material is sealed within the flexible enclosure under air-evacuated conditions, and the anode is attached to an exterior of the flexible enclosure, whereby in use, the compressible material expands to press the anode into contact with a surface of the reinforced concrete structure when air is caused to re-enter the flexible enclosure; and wherein each anode comprises a first and a second layer of anode material, the second layer of anode material being smaller than the first layer of anode material, and wherein the anode connector extends between the first and second layers of anode material, wherein the first and second layers of anode material are welded together, thereby securing the anode connector therebetween and forming a connection with the anode, and the first and second layers of anode material comprise zinc or zinc alloy.

2. The array of anode assemblies according to claim 1, wherein the flexible enclosure is made of a plastic material.

3. The array of anode assemblies according to claim 1, wherein the flexible enclosure is made of a thermoplastic material.

4. The array of anode assemblies according to claim 1, wherein the flexible enclosure comprises an inner layer and an outer layer, wherein the inner layer is a heat-sealable layer and the outer layer is an air-impermeable layer.

5. The array of anode assemblies according to claim 1, wherein the flexible enclosure comprises a heat-sealable material.

6. The array of anode assemblies according to claim 1, wherein an inner surface of the flexible enclosure is dimpled.

7. The array of anode assemblies according to claim 1, wherein the compressible material is an open cell foamed material.

8. The array of anode assemblies according to claim 7, wherein the open cell foamed material has a density of between 50 and 100 kg/m$^3$.

9. The array of anode assemblies according to claim 7, wherein the open cell foamed material comprises a polyurethane.

10. The array of anode assemblies according to claim 1, wherein the flexible enclosure comprises a heat seal for sealing the compressible material inside the flexible enclosure.

11. The array of anode assemblies according to claim 1, wherein each anode is a discrete anode and the anode connector of each anode assembly is interconnected via an interconnecting conductor.

12. The array of anode assemblies according to claim 1, wherein each anode is an inert anode for use in an impressed current cathodic protection treatment or a sacrificial anode for use in a sacrificial cathodic protection treatment.

13. The array of anode assemblies according to claim 1, wherein at least one anode assembly comprises a second anode attached to the expandable member opposite the attached anode.

14. The array of anode assemblies according to claim 1, wherein at least one anode assembly comprises a second anode attached to the expandable member opposite the attached anode, and the second anode is provided on an exterior surface of the flexible enclosure opposite the attached anode.

15. The array of anode assemblies according to claim 1, wherein the anode is attached to the expandable member using an elastomeric adhesive.

16. The array of anode assemblies according to claim 1, wherein a ratio of unexpanded to expanded assembly thickness is at least 1:2.

17. The array of anode assemblies according to claim 1, wherein the ratio of unexpanded to expanded assembly thickness is from about 1:2 to about 1:10.

18. The array of anode assemblies according to claim 1, wherein each anode measures at most 400 mm (15.748 inches) by 400 mm (15.748 inches).

19. The array of anode assemblies according to claim 1, wherein each anode assembly has a maximum thickness, in an unexpanded state, of at most 15 mm (0.591 inches).

20. The array of anode assemblies according to claim 1, wherein the anode connector comprises titanium.

21. The array of anode assemblies according to claim 1, wherein at least one anode assembly comprises a first flexible enclosure and a second flexible enclosure arranged next to the first flexible enclosure, and a compressible material sealed within each flexible enclosure, under air-evacuated conditions in each flexible enclosure, whereby in use, the at least one anode assembly is inserted into the gap between the section of the reinforced concrete structure and the solid structure with the compressible material in the first and/or second flexible enclosure in a compressed state, the compressible material in the first and/or second flexible enclosure being configured to expand so as to press the anode into contact with a surface of the reinforced concrete structure when air is caused to re-enter the first and/or second flexible enclosure.

22. The array of anode assemblies according to claim 21, wherein the first flexible enclosure is attached to the second flexible enclosure.

23. The array of anode assemblies according to claim 22, wherein the first flexible enclosure is attached to the second flexible enclosure by an adhesive.

24. The array of anode assemblies according to claim 21, comprising a first and a second anode, wherein the first and second anodes are attached on corresponding exterior surfaces of the first and second flexible enclosures, facing away from one another.

25. The array of anode assemblies according to claim 1, comprising at least ten anode assemblies.

26. The array of anode assemblies according to claim 1, wherein at least one of the anode assemblies comprises a reference electrode mounted to and electrically isolated from the anode, and a reference electrode conductor for connecting the reference electrode to a measuring apparatus, the reference electrode conductor being electrically isolated from the anode.

27. The array of anode assemblies according to claim 1, wherein the anode assemblies are arranged at a density of at least two assemblies per square meter of reinforced concrete surface.

28. A structure comprising a gap between a section of a reinforced concrete structure and another solid structure, the structure containing in the gap the array of anode assemblies according to claim 1.

* * * * *